US011724917B2

(12) United States Patent
Studer et al.

(10) Patent No.: US 11,724,917 B2
(45) Date of Patent: Aug. 15, 2023

(54) ALIGNING DEVICE AND METHOD FOR ALIGNING A GUIDE RAIL OF AN ELEVATOR SYSTEM BY MEANS OF FORCE PULSES

(71) Applicant: Inventio AG, Hergiswil (CH)

(72) Inventors: Christian Studer, Kriens (CH); Eliza Olczyk, Lucerne (CH)

(73) Assignee: INVENTIO AG, Hergiswil (CH)

( * ) Notice: Subject to any disclaimer, the term of this patent is extended or adjusted under 35 U.S.C. 154(b) by 71 days.

(21) Appl. No.: 17/595,323

(22) PCT Filed: May 8, 2020

(86) PCT No.: PCT/EP2020/062842
§ 371 (c)(1),
(2) Date: Nov. 15, 2021

(87) PCT Pub. No.: WO2020/234005
PCT Pub. Date: Nov. 26, 2020

(65) Prior Publication Data

US 2022/0212897 A1 Jul. 7, 2022

(30) Foreign Application Priority Data

May 21, 2019 (EP) ..... 19175502

(51) Int. Cl.
*B66B 19/00* (2006.01)

(52) U.S. Cl.
CPC ..... *B66B 19/002* (2013.01)

(58) Field of Classification Search
CPC ..... B66B 19/002
See application file for complete search history.

(56) References Cited

U.S. PATENT DOCUMENTS 10,315,887 B2 * 6/2019 Kilpeläinen ..... B66B 7/023
2009/0266651 A1 * 10/2009 van der Meijden .... B66B 19/00 52/741.1
2013/0233654 A1 * 9/2013 Cao ..... B66B 7/025 187/407
2014/0138189 A1 * 5/2014 van der Meijden .. B66B 5/0087 187/406

(Continued)

FOREIGN PATENT DOCUMENTS

CN 105829234 A 8/2016
CN 106458515 A 2/2017

(Continued)

*Primary Examiner* — Michael A Riegelman
(74) *Attorney, Agent, or Firm* — William J. Clemens; Shumaker, Loop & Kendrick, LLP

(57) ABSTRACT

An aligning device is used for aligning a guide rail of an elevator system. The guide rail is held on a shaft wall of an elevator shaft and is displaceable in at least two horizontal directions, oriented crosswise with respect to each other, before a final fixation. The aligning device has a detection device that is configured to detect, in an automated manner, a position deviation of the guide rail from a nominal position, and has a hammer mill that is configured to hammer the guide rail in an automated manner depending on the detected position deviation by exerting pulse-like strikes in one of the horizontal directions toward the nominal position.

14 Claims, 4 Drawing Sheets

(56) References Cited

U.S. PATENT DOCUMENTS

| | | | | |
|---|---|---|---|---|
| 2015/0128403 | A1* | 5/2015 | Valkama | B66B 19/002 29/281.6 |
| 2015/0217972 | A1* | 8/2015 | Hawkins | G01C 15/10 187/408 |
| 2016/0068369 | A1* | 3/2016 | Valkama | B66B 5/0087 33/645 |
| 2016/0311657 | A1* | 10/2016 | Kilpeläinen | B66B 19/002 |
| 2016/0311658 | A1* | 10/2016 | Kilpeläinen | B66B 19/002 |
| 2016/0311659 | A1* | 10/2016 | Mertala | E04G 3/246 |
| 2016/0325968 | A1* | 11/2016 | Baker | B66B 13/08 |
| 2017/0313553 | A1* | 11/2017 | Püntener | B66B 19/002 |
| 2018/0208439 | A1* | 7/2018 | Studer | B66B 11/0005 |
| 2019/0106296 | A1* | 4/2019 | Barneman | B66B 19/00 |
| 2019/0367328 | A1* | 12/2019 | Cambruzzi | B32B 37/00 |
| 2020/0055709 | A1* | 2/2020 | Cambruzzi | B66B 19/002 |
| 2021/0016998 | A1* | 1/2021 | Haag | B66B 7/024 |
| 2021/0300729 | A1* | 9/2021 | Cambruzzi | B66B 19/00 |
| 2021/0323793 | A1* | 10/2021 | Cambruzzi | B66B 19/00 |
| 2022/0024722 | A1* | 1/2022 | Hosemann | B66B 7/024 |
| 2022/0080546 | A1* | 3/2022 | Cambruzzi | B23Q 17/2457 |
| 2022/0212897 | A1* | 7/2022 | Studer | B66B 19/002 |

FOREIGN PATENT DOCUMENTS

| | | | |
|---|---|---|---|
| CN | 107074491 | A | 8/2017 |
| CN | 107848768 | A | 3/2018 |
| DE | 10249139 | A1 | 5/2004 |
| EP | 3085657 | A1 | 10/2016 |
| JP | H0624667 | A | 2/1994 |
| JP | H09110335 | A | 4/1997 |
| JP | H09208152 | A | 8/1997 |
| WO | 2018095739 | A1 | 5/2018 |

* cited by examiner

ALIGNING DEVICE AND METHOD FOR ALIGNING A GUIDE RAIL OF AN ELEVATOR SYSTEM BY MEANS OF FORCE PULSES

FIELD

The present invention relates to an aligning device for aligning a guide rail of an elevator system. The invention also relates to a method for aligning a guide rail of an elevator system and to an elevator system equipped with the aligning device.

BACKGROUND

In elevator systems, elevator cars are generally moved vertically within an elevator shaft between different levels or floors. The elevator car is generally guided by one or more guide rails during the movement of the car. A guide rail is usually anchored to a side shaft wall of the guide shaft. The guide rail must be able to absorb the forces exerted on it by the elevator car, mainly in the horizontal direction, and to transfer them to the elevator shaft wall. The same guide rails or additional guide rails can be used to guide one or more counterweights during their vertical movement through the elevator shaft.

In order to be able to precisely guide the elevator car and/or the counterweight, the guide rails generally have to be aligned very precisely. The guide rails should generally be fastened to the elevator shaft walls so as to extend exactly vertically, i.e. perpendicularly. In particular, in the case of high elevator shafts, the guide rails cannot run exactly perpendicularly either. They then follow the course of the elevator shaft. Deviations from a precise positioning or orientation of the guide rails should be as small as possible, for example less than a few millimeters, in order to be able to keep wear-promoting loads on components of the elevator system low when moving the elevator car and/or the counterweight and/or in order to reduce vibrations on the elevator car caused by the guide on the guide rails during travel of the car and thus improve the comfort of the elevator system.

Conventionally, guide rails are fastened to shaft walls using rail bracket parts. Typically, a lower rail bracket part is fastened directly to one of the shaft walls, for example by being screwed to anchor bolts or counterparts that have been previously cast in concrete. An upper rail bracket part is then attached to the lower rail bracket part. The rails are then attached to the upper rail bracket part.

Before the upper rail bracket part is finally firmly fixed to the lower rail bracket part, for example by using screws, both rail bracket parts can be moved relative to one another. In most cases, the two rail bracket parts can be displaced relative to one another in a horizontal plane, that is to say along two horizontal directions running transversely to one another. By moving the two rail bracket parts in relation to one another in this way, the upper rail bracket part can be brought into such a position and/or orientation that the guide rail attached can be arranged at a desired positioning within the elevator shaft.

To date, within the context of assembling an elevator system, the lower rail bracket parts have mostly been fastened at suitable positions within the elevator shaft, then the upper rail bracket parts are fixed, loosely or still movable under force, to the lower rail bracket parts and then the guide rails are fixed to the upper rail bracket parts. The upper rail bracket parts can then be shifted laterally by a fitter, for example by a few millimeters or even a few centimeters, relative to the lower rail bracket parts.

Devices or aids have been developed to support the installation or adjustment of guide rails. WO 2018/095739 A1 describes a method and an aligning device for mounting or aligning a guide rail in an elevator shaft. JP 2829194 (corresponding to JPH06024667) describes a device and a method for aligning and fixing elevator guide rails.

Aligning guide rails in a guide shaft was previously very expensive and/or difficult to implement with high precision and/or required an experienced installer.

SUMMARY

Among other things, there may be a need for an aligning device and a method for aligning a guide rail of an elevator system using which the guide rail can be aligned simply and/or with high precision with regard to its positioning and/or orientation. In particular, there may be a need for an approach in which the guide rail can be aligned in a largely automated, reliable and/or damage-free manner. Furthermore, there may be a need for an elevator system having such an aligning device.

A need of this kind can be met by the subject matter according to any of the advantageous embodiments that are defined in the following description.

According to a first aspect of the invention, an aligning device for aligning a guide rail of an elevator system is described. The guide rail is held on a shaft wall of an elevator shaft and can be displaced in at least two horizontal directions aligned crosswise to each other before a final fixation. The aligning device comprises a detection device and a hammer mill. The detection device is configured to automatically detect a position deviation of the guide rail from a nominal position. The hammer mill is configured to automatically hammer the guide rail as a function of the detected position deviation by exerting pulse-like strikes in one of the horizontal directions towards the nominal position and thus to displace or reorient it towards the nominal position.

According to a second aspect of the invention, an elevator system is described having a guide rail held on a shaft wall of an elevator shaft, a vertically displaceable elevator component guided in its vertical movement by the guide rail, and an aligning device according to an embodiment of the first aspect of the invention, wherein the aligning device is fastened to the elevator component.

According to a third aspect of the invention, a method for aligning a guide rail of an elevator system is proposed. The guide rail is held on a shaft wall of an elevator shaft and is displaceable in at least two horizontal directions aligned crosswise to each other before a final fixation. The method comprises at least the following steps, preferably in the order given:

automated detection of a position deviation of the guide rail from a nominal position by means of a detection device of an aligning device according to an embodiment of the first aspect of the invention, and automated displacement of the guide rail by exerting pulse-like strikes on the guide rail in one of the horizontal directions toward the nominal position by means of a hammer mill of an aligning device according to an embodiment of the first aspect of the invention.

The mentioned guide rails can serve to guide an elevator car and/or a counterweight.

Possible features and advantages of embodiments of the invention can be considered, among others and without limiting the invention, to be based upon the concepts and findings described below.

As already indicated in the introduction, the aligning of a guide rail of an elevator system is intended to be simplified and/or carried out more precisely, for example in the context of assembly or maintenance.

To summarize briefly, an aligning device is proposed for this purpose, in which a detection device and a hammer mill work together in order to first be able to recognize the extent to which the guide rail deviates from a nominal position, and then to automatically move the guide rail to the nominal position, in which it is automatically hammered horizontally with pulse-like strikes, in corresponding directions and thus shifted or reoriented.

As a starting point, it is assumed that the guide rail to be aligned is already attached to the shaft wall of the elevator shaft to the extent that it is held on the shaft wall and cannot be detached from it without damage, but is not yet finally fixed to the shaft wall. Accordingly, the guide rail can still be moved slightly, i.e. by a few millimeters or even a few centimeters, relative to the shaft wall by means of a suitable application of force. For this purpose, upper rail bracket parts and lower rail bracket parts, by means of which the guide rail is held on the shaft wall, can initially be connected only relatively loosely to one another, for example by not fully tightening the connecting screws.

In such an initial situation, the aligning device presented here can be arranged on or in the vicinity of a section of the guide rail to be aligned.

The detection device of the aligning device can then be used to examine whether the guide rail is at a desired nominal position or whether there is a position deviation from this nominal position, i.e. whether the guide rail is spaced apart from the nominal position in a horizontal direction.

The detection device can use different types of sensors for this purpose. A sensor system can touch the guide rail or interact with the guide rail without contact in order to be able to determine an actual position of the guide rail. Various mechanical, optical, electrical, magnetic or other physical principles can be used to measure the position of the guide rail.

For example, the sensor system can optically detect the actual position of the guide rail. For this purpose, according to one embodiment, the sensor system of the detection device can be configured to detect the position deviation between the actual position of the guide rail and the nominal position by scanning the guide rail using a laser. A laser beam emitted by the laser can be aligned or guided in such a way that it strikes the guide rail at one position or scans the guide rail at several positions. Using various measurement methods such as TOF measurements (Time Of Flight) of the laser beam emitted by the laser or trigonometric calculations based on laser measurements from different directions, conclusions can be drawn about the distance between the guide rail and the laser and thus about the actual position of the guide rail.

Alternatively, other optical methods can also be used in order to be able to carry out a position measurement, in particular a distance measurement. For example, a camera, in particular a TOF camera, can be used to measure the position of the guide rail.

The detection device can also have information about a reference position. This reference position can coincide with the nominal position or be arranged in a known spatial relationship to this.

For example, according to one embodiment, the position deviation can be detected by recognizing an actual position of the guide rail relative to a position of a plumb bob serving as a reference.

In other words, a plumb bob can be suspended in the elevator shaft, for example in the form of a cord weighted down with a weight, with the aid of which a usually perfectly vertical direction is indicated. The position of this vertical can be determined, for example with the aid of the laser already mentioned above, and serve as a reference, with respect to which the position of the guide rail can then be determined. Since the position and direction of the plumb bob can be known in advance, information about the actual position of the guide rail in relation to the reference position can be obtained in this way.

From the information about the reference position and the information about the actual position of the guide rail, the detection device can then automatically determine the desired information about the position deviation of the guide rail from the nominal position. This information can be determined, for example, as a vector between the actual position of the guide rail in the horizontal direction and the nominal position, wherein the vector reproduces both the distance and the direction between the named positions.

The nominal position of the guide rail can also be determined from a digital model of the elevator shaft that was created by measuring the elevator shaft. The actual position of the guide rail can also be determined using the digital model, for example by means of image recognition and comparison with the digital model. This means that the named vector can also be determined without using a plumb bob.

Based on the knowledge of this vector, the guide rail can then be moved to the nominal position by exerting forces on the guide rail.

It was recognized as important that the guide rail is not acted upon with the aid of a static force or a force that changes only slowly over time, since in this case a risk was recognized that the guide rail would be elastically deformed by the application of force and with the end of the application the force goes back to its position from before the start of the application of force or at least wants to go back. In addition, the aforementioned application of force can result in the guide rail being plastically deformed, in particular bending and/or twisting.

Instead, it has been recognized as advantageous to hammer the guide rail in a desired horizontal direction with the aid of pulse-like strikes, that is to say by abrupt brief application of force, and thus to shift or reorient it in the aforementioned horizontal direction.

Each individual pulse-like strike can be significantly shorter than, for example, 1 s, preferably even shorter than 0.1 s or shorter than 0.01 s, calculated from the beginning to the end of the application of force to the guide rail. Each individual pulse-like strike can briefly exert very high forces on the guide rail, for example forces of more than 10 kN, more than 50 kN, more than 100 kN or even more than 200 kN.

A single strike can be caused, for example, by first accelerating a mass in the desired horizontal direction or tangentially to it and then suddenly braking it by hitting the guide rail or a workpiece that interacts mechanically with the guide rail.

According to one embodiment, the hammer mill can be configured to exert pulse-like strikes on the guide rail in and against each of the at least two horizontal directions.

In other words, the hammer mill can be designed to exert pulse-like strikes on the guide rail in at least four directions, i.e. both in a first horizontal direction and against this first horizontal direction and in a second horizontal direction and against this second horizontal direction. The first and the second horizontal direction are oriented transversely to one another, preferably at right angles to one another. The first horizontal direction can be referred to as the x-direction and the second horizontal direction as the y-direction. For example, the first horizontal direction can be orthogonal to the shaft wall and the second horizontal direction can be directed parallel to the shaft wall.

Since the hammer mill can exert strikes on the guide rail in such directions transversely to one another, the guide rail can be displaced along any vector within a horizontal plane.

According to one embodiment, the hammer mill can in particular be configured to exert pulse-like strikes on the guide rail in and against the horizontal direction orthogonally to the shaft wall at two positions which are spaced apart from one another in a horizontal direction parallel to the shaft wall.

In other words, the hammer mill can be designed in such a way that it can exert strikes on the guide rail not only at a single position, which strikes are directed horizontally towards the shaft wall or away from the shaft wall. Instead, the hammer mill should be designed to be able to exert such strikes on the guide rail at two different positions, wherein the two positions are spaced apart from one another in a direction transverse to the direction of the strikes, i.e. in a direction parallel to the shaft wall.

A distance between the two positions can be in the range of a few centimeters. For example, the distance between the two positions can correspond to between 10% and 99%, preferably between 30% and 90%, of the width of the guide rail, wherein this width is measured in the horizontal direction parallel to the shaft wall.

Since strikes can be exerted on the guide rail by the hammer mill at two spaced-apart positions on the one hand towards the shaft wall and on the other hand away from the shaft wall, not only forces but also torques can be exerted on the guide rail in a way that can be influenced in a targeted manner.

For example, the hammer mill can hammer on the guide rail at the first position in a direction towards the shaft wall and simultaneously hammer on the guide rail at the second position in a direction away from the shaft wall. As a result, the guide rail as a whole may not be displaced, but only rotated, i.e. reoriented.

In addition to the possibility of changing the position of the guide rail by the strikes caused by the hammer mill, there can also be the possibility of locally changing the orientation of the guide rail with the aid of the hammer mill.

In order to be able to generate the described pulse-like strikes, according to one embodiment the hammer mill can have at least one actuator for the automated generation of pulse-like strikes and at least four impact transmission devices for transmitting the impacts generated to partial regions on the guide rail.

In other words, the hammer mill can have one actuator or several actuators. Each actuator can here accelerate a mass in a desired horizontal direction, wherein the accelerated mass is then able to be braked abruptly in order to generate a pulse-like strike. For example, the accelerated mass can collide with one of the impact transmission devices and suddenly transfer its kinetic energy to it. Alternatively, the accelerated mass can suddenly transfer its kinetic energy to one of the impact transmission devices via a mechanism such as one or more levers or a gear mechanism.

The individual impact transmission devices can then, because of their physical configuration, i.e. in particular because of their geometry, be designed to transmit the pulse-like strikes generated by the actuator to a desired partial region on the guide rail. An impact transmission device can be formed, for example, by a single straight or curved or angled rod or possibly by a plurality of such rods. Each of the at least four impact transmission devices can be designed in such a way that the strike it transmits is exerted on the guide rail in one of the above-described horizontal directions running crosswise to each other.

With the help of such a hammer mill, the guide rail can be moved to any position within a horizontal plane as described above.

The use of several actuators also makes it possible to execute strikes in different directions at the same time or at least in quick succession. This allows the guide rail to be aligned particularly quickly.

According to one alternative embodiment, the hammer mill can have at least one actuator for the automated generation of pulse-like impacts and not only four, but at least six impact transmission devices for transmitting the impacts generated to partial areas on the guide rail.

The actuator or the actuators as well as the impact transmission devices can be designed in a similar way to the embodiment described above. However, two impact transmission devices can be provided in order to be able to exert pulse-like strikes on the guide rail at two laterally spaced positions on the one hand in a direction towards the shaft wall and on the other hand in a direction away from the shaft wall. As described above, torques can also be applied to the guide rail in this way.

According to one further specific embodiment, the at least one actuator can be arranged on a side of the guide rail facing away from the shaft wall and at least one of the impact transmission devices can be configured to engage behind the guide rail on a side facing the shaft wall.

In other words, provision can be made not to arrange the actuator or the actuators of the hammer mill between the guide rail and the shaft wall, where there is usually little space available, but rather on the side of the guide rail opposite the shaft wall. This means that the actuator can be arranged closer to the center of the elevator shaft than the guide rail positioned near the shaft wall.

In order to still be able to use the hammer mill to cause strikes against the guide rail, which are directed in a direction away from the shaft wall, it can be provided that the actuator used for this purpose should interact with a specially designed impact transmission device. This impact transmission device is intended to engage behind the guide rail on the side facing the shaft wall in order to be able to effect the desired strikes on the guide rail with the part engaging behind the guide rail.

Such an impact transmission device may, for example, have two or more arms. One of the arms can engage behind the guide rail in an intermediate space between the guide rail and the shaft wall and one or more other arms can be used for a mechanical coupling with the actuator in order to transmit the strikes generated by the actuator to the arm engaging behind the guide rail. Such an impact transmission device can be designed, for example, L-shaped or C-shaped.

According to one embodiment, one actuator can interact individually with an impact transmission device.

In other words, the number of actuators can correspond to the number of impact transmission devices and in each case one of the actuators can interact with only one of the impact transmission devices.

The actuators can preferably be controlled individually so that the pulse-like strikes generated by them can optionally be generated independently of one another in different horizontal directions via the respectively assigned impact transmission devices.

Alternatively, an individual actuator can in principle also be designed and/or cooperate with impact transmission devices such that it can interact with a plurality of impact transmission devices. For example, a switchable mechanism or a switchable transmission can be used to ensure that the actuator only interacts with one of the impact transmission devices at a given point in time, so that the generation of pulse-like strikes can be controlled independently of one another via the various impact transmission devices in the various horizontal directions.

According to one embodiment, the actuator can have a rotatable motor and a hammer mechanism for converting a rotational movement caused by the motor into a pulse-like linear movement in the form of the pulse-like strikes.

In other words, the actuator of the hammer mill can comprise a motor, in particular an electric motor, which can, for example, set a shaft in rotation. Similar to a hammer drill, a hammer mechanism can be mechanically coupled to the rotating shaft, which converts the rotational movement of the shaft into a pulse-like linear movement. In this linear movement, for example, a mass can initially be linearly accelerated by the rotational movement and its kinetic energy can then suddenly be transferred, for example to a stop element. The abruptly force-applied stop element can in turn interact with one of the impact transmission devices in order to ultimately transmit the pulse-like strikes to the guide rail.

Such a design of the hammer mill and the actuator used therein can be designed similarly to a hammer drill and can be implemented simply, inexpensively and robustly.

Alternatively, the actuator can be designed as an air cushion hammer mechanism. An example of an air cushion hammer mechanism is described in DE 102 49 139 A1.

According to one embodiment, the aligning device can furthermore have a fixing device for fixing the aligning device on an elevator component that can be moved through the elevator shaft.

In other words, with the aid of a fixing device, the aligning device can be specially designed to be attached to an elevator component that can be moved vertically within the elevator shaft. Such a movable elevator component can be, for example, an elevator car, a counterweight or a vertically displaceable installation platform to be temporarily used during an installation process. With the aid of the fixing device, the aligning device can be attached simply and reliably to the movable elevator component and preferably detached from the movable elevator component again after the guide rail has been aligned. The fixing device can be designed in a technically simple manner, for example with the help of metal sheets and screws, with which the aligning device can be fixed, for example, at suitable holding points on the movable elevator component.

Embodiments of the aligning device described herein can be used for an elevator system according to an embodiment of the second aspect of the invention. The elevator system has a movable elevator component such as an elevator car which, when it moves vertically through an elevator shaft, is guided laterally by at least one guide rail. The aligning device described herein is at least temporarily attached to the movable elevator component. Accordingly, the aligning device, together with the movable elevator component, can be moved vertically to different positions along the vertically extending guide rail and there, if necessary, can align the guide rail into its desired position.

Accordingly, with the aid of embodiments of the method also described herein according to the third aspect of the invention, a position and/or orientation of the guide rail can be set by suitable hammering of the guide rail with the aid of the hammer mill of the aligning device presented here, after any positional deviation of the guide rail from the nominal position was detected with the aid of the detection device of the aligning device.

The aligning device is arranged on the guide rail in particular in the region of a slide bracket having a lower rail bracket part and an upper rail bracket part, by means of which the guide rail is fastened to a shaft wall. In particular, it is also possible for more than one aligning device, in particular at least three aligning devices, to be arranged on the guide rail at the same time, by means of which pulse-like strikes are exerted on the same guide rail at the same time or only by one aligning device. It is particularly advantageous if an aligning device is arranged in the area of each rail bracket assigned to a guide rail.

The arrangement of several aligning devices on a guide rail enables a particularly precise alignment of the guide rail, since pulse-like strikes exerted at one point can influence a previous alignment of the guide rail at another point. The arrangement of a plurality of aligning devices on a guide rail enables either simultaneous alignment at different locations or a quick check of the effects of an alignment at one location on the previous alignment at another location. The alignment of the guide rail can take place, for example, in an iterative process in which pulse-like strikes are applied to different locations one after the other.

It is noted that some of the possible features and advantages of the invention are described herein with reference to different embodiments of the aligning device, the elevator system equipped therewith or the aligning method to be carried out therewith. A person skilled in the art recognizes that the features can be combined, adapted, transferred or exchanged in a suitable manner in order to arrive at further embodiments of the invention.

Embodiments of the invention will be described in the following with reference to the accompanying drawings, with neither the drawings nor the description being intended to be interpreted as limiting to the invention.

The drawings are merely schematic and not to scale. Like reference signs denote like or equivalent features in the various drawings.

DETAILED DESCRIPTION

Figure 1:
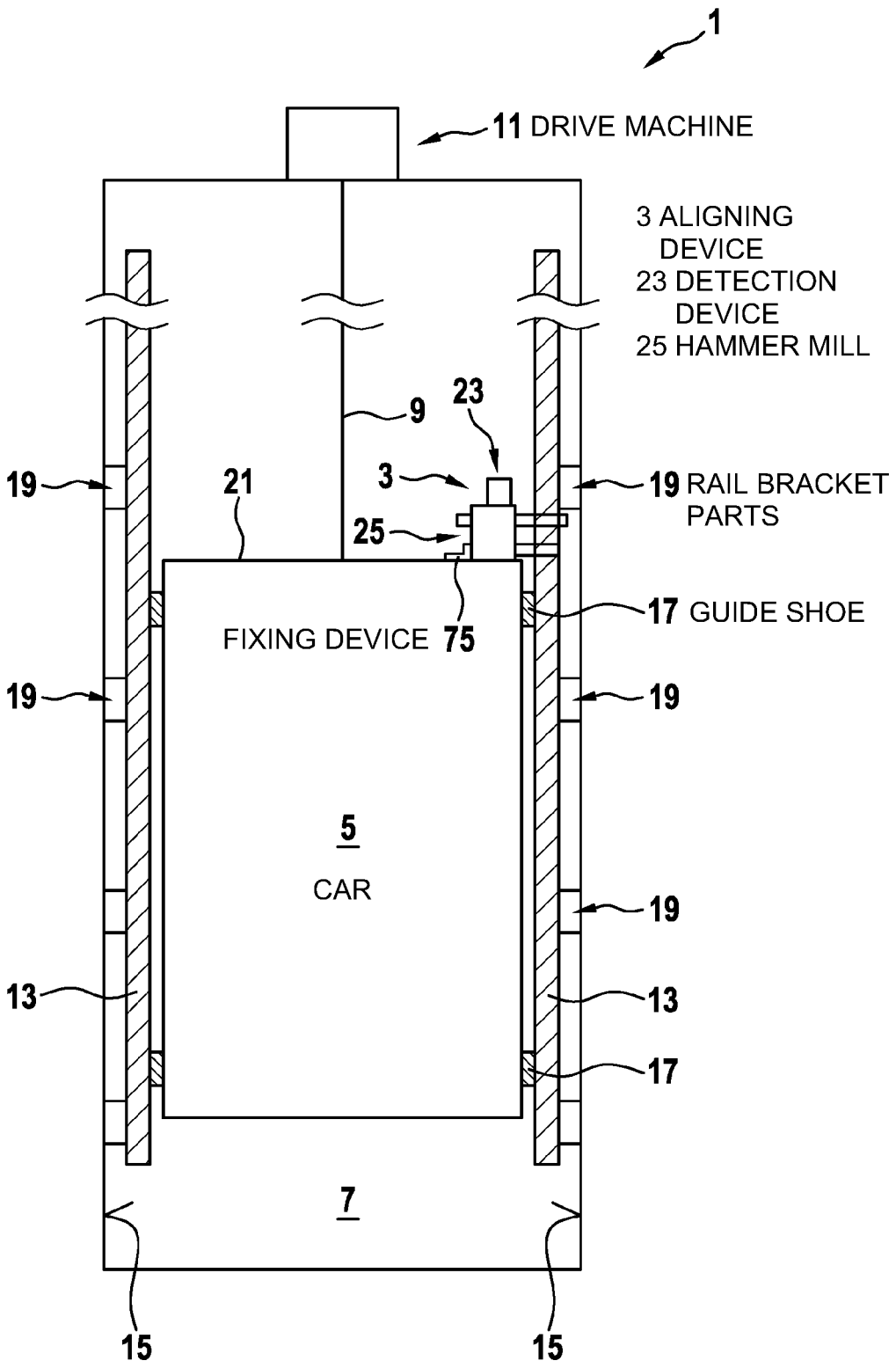
FIG. 1 shows an elevator system according to an embodiment of the present invention.

FIG. 1 shows an elevator system 1 having an aligning device 3 according to one embodiment of the present invention.

In the elevator system 1, an elevator car 5 can move vertically as a movable component within an elevator shaft 7. It is moved by means of a rope-like suspension means 9 which is driven by a drive machine 11.

In particular, in order to prevent the elevator car 5 from lateral movements such as for example swinging within the elevator shaft 7, it is guided by guide rails 13 during its vertical movement. The guide rails 13 can be designed, for example, as a T-profile carrier. The elevator car 5 is supported on the guide rails 13 via guide shoes 17 or the like. The guide rails 13 are each anchored on a lateral shaft wall 15.

In order to simplify correct positioning of the guide rails 13 or to be able to change them later, the guide rails 13 are not attached directly to the shaft wall 15, but are connected to it via a plurality of the rail bracket parts 19. A base area 45 (see FIG. 2) of the T-profile-like guide rails 13 can be attached to the rail bracket parts 19. The rail bracket parts 19 are usually designed in at least two parts. A lower rail bracket part fixed to the shaft wall 15 is mechanically coupled to an upper rail bracket part carrying the guide rail 13. The lower part of the rail bracket and the upper part of the rail bracket can be firmly connected to one another using screws, for example.

During an installation of the guide rails 13 or as part of a maintenance of the elevator system 1, the upper and lower parts of the rail bracket can temporarily only be loosely coupled with each other, so that the guide rail 13 is held on the shaft wall 15, but can be shifted in two directions aligned horizontal to one another before the rail bracket parts are finally fixed in place. For this purpose, the rail bracket parts can be coupled to one another by means of screws, for example, which do not run through round holes, but rather through elongated holes in the rail bracket parts. Accordingly, the rail bracket parts can be displaced relative to one another in a direction transverse to the screws. In this state, the position of the guide rail 13 can be shifted within a horizontal plane with the aid of the aligning device 3 and the guide rail 13 can be moved in this way to a nominal position.

For this purpose, the aligning device 3 can be attached to a displaceable component such as the elevator car 5 and can be moved together with it through the elevator shaft 7 to a vertical position at which the horizontal position of the guide rail 13 is to be aligned. Since the aligning device 3 can be moved to different heights within the elevator shaft 7 together with the displaceable component, the entire guide rail 13 can be successively aligned into its nominal position in this way. In the example shown, the aligning device 3 is fastened to a car roof 21 of the elevator car 5 with the aid of a fixing device 75.

The aligning device 3 is arranged on the guide rail 13 by means of the elevator car, in particular in the area of the rail bracket parts 19.

It is also possible to arrange more than one aligning device at the same time, in particular at least three aligning devices, on the same guide rail, by means of which pulse-like strikes are exerted on the same guide rail at the same time or only by one aligning device. An aligning device is then arranged in particular in the region of each rail bracket assigned to a guide rail. With the multiple aligning devices, the guide rail can be aligned at different points at the same time. Alternatively, an alignment can only be carried out at one point and then the effects of this alignment on previous alignments at the other points can be checked. The alignment of the guide rail can thus take place in an iterative process in which pulse-like strikes are applied to different points one after the other.

Figure 2:
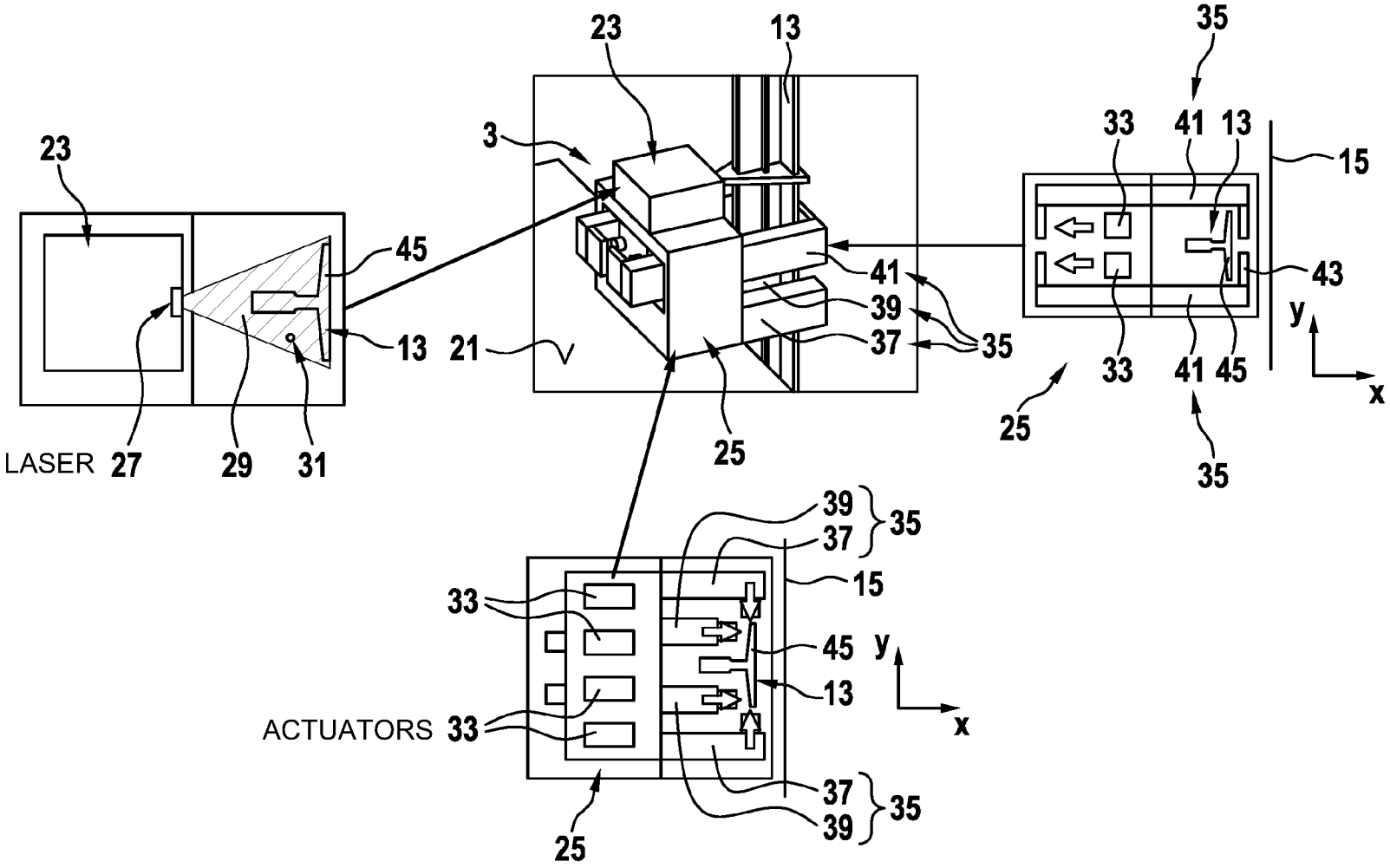
FIG. 2 shows a perspective view of an aligning device according to one embodiment of the present invention and several plan views of partial areas of this aligning device.

As shown in more detail in FIG. 2 and its partial views, the aligning device 3 has a detection device 23 and a hammer mill 25.

With the aid of the detection device 23, the aligning device 3 can detect an actual position of the guide rail 13 and, based thereon, a position deviation of the guide rail 13 from a nominal position. Based on information about the position deviation detected in this way, the aligning device 3 can then exert pulse-like strikes on the guide rail 13 with its hammer mill 25 and in this way automatically hammer it in a horizontal direction towards the horizontal position and thus shift it or reorient it to the nominal position.

The detection device 23 can detect a position deviation of the guide rail 13, for example, by measuring an actual position of the guide rail 13 relative to a position of a plumb bob 31 serving as a reference. For this purpose, the detection device 23 can have a laser 27 which, with the aid of a preferably horizontally deflectable laser beam 29, can detect the actual position of the guide rail 13 and, in addition, can preferably also detect the position of the plumb bob 31. On the basis of the information obtained in this way, the detection device 23 can infer any position deviation of the guide rail 13 from a previously known nominal position.

Based on the information obtained in this way, the hammer mill 25 can then exert pulse-like strikes on the guide rail 13 in order to move it horizontally towards its nominal position.

For this purpose, the hammer mill 25 has one or more actuators 33 (only shown very schematically in FIG. 2 for reasons of clarity), which can interact with several impact transmission devices 35. The actuators 33 can automatically generate pulse-like strikes and transmit them to subregions of the guide rail 13 via the impact transmission devices 35. The actuators 33 can advantageously be arranged on a side of the guide rail 13 facing away from the shaft wall 15.

In the example shown, the hammer mill 25 has two first impact transmission devices 37, with the aid of which pulse-like strikes can be exerted on a base region 45 of the T-shaped guide rail 13, on the one hand in a +y direction and on the other hand in a −y direction, each parallel to the shaft wall 15.

The hammer mill 25 also has second and third impact transmission devices 39, 41, with the aid of which pulse-like strikes can be exerted on the base region 45 of the guide rail 13, on the one hand in a +x direction and on the other hand in a −x direction, each orthogonal to the shaft wall 15.

Two second impact transmission devices 39 are provided, which act on the base region 45 of the guide rail 13 in the +x direction towards the shaft wall 15 and can initiate the pulse-like strikes. Each of the two second impact transmission devices 39 introduces its strikes on the base region 45 at one of two positions, wherein the two positions are spaced apart from one another laterally, that is to say in the y direction.

Furthermore, two third impact transmission devices 41 are provided, which act on the base region 45 of the guide rail 13 on a side opposite the shaft wall 15 and there can initiate the pulse-like strikes directed away from the shaft wall 15 in the −x direction. Each of the two third impact transmission devices 41 in turn initiates its strikes on the base region 45 at one of two positions, wherein the two positions are laterally spaced from one another.

In order not to have to arrange the actuators 33 cooperating with the third impact transmission devices 41 in the limited space between the guide rail 13 and the shaft wall 15, but to be able to arrange them on the side of the guide rail 13 opposite the shaft wall 15, the third impact transmission devices 41 are C-shaped. With an arm region 43 running parallel to the shaft wall 15, the third impact transmission devices 41 can each engage behind the base region 45 of the guide rail 13 in order to be able to exert the pulse-like strikes on them in the −x direction directed away from the shaft wall 15.

Figure 3C:
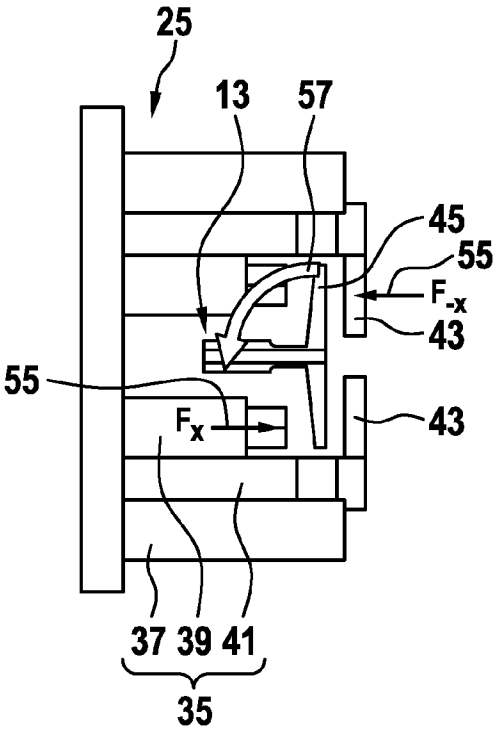
FIGS. 3A-3C illustrate various horizontal directions in which a guide rail can be displaced with the aid of an aligning device according to the invention.
Figure 3B:
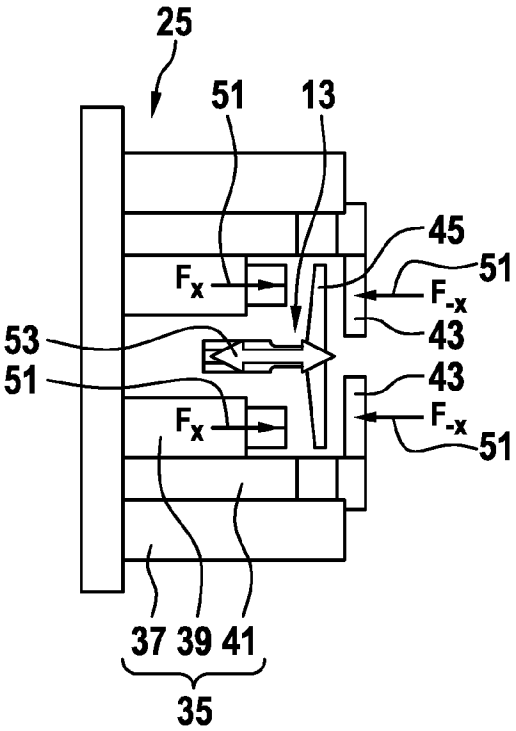
Figure 3A:
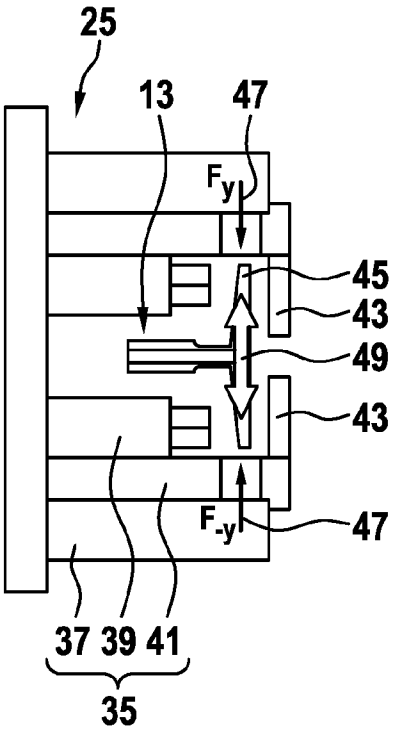

In the drawings: FIGS. 3A-3C show the impact transmission devices 35 of the hammer mill 25 and the displacements of the guide rail 13 that can be brought about with them. FIG. 3A uses force arrows 47 to illustrate the y-directions in which forces $F_y$ and $F_{-y}$ are exerted by the first impact transmission devices 37 on the base region 45 of the guide rail 13 in order to move the guide rail 13 in a y-displacement direction 49 parallel to the shaft wall 15. FIG. 3B uses force arrows 51 to illustrate the x-directions in which the second and third impact transmission devices 39, 41 exert equally strong forces $F_x$ or $F_{-x}$ on the base region 45 of the guide rail 13 at laterally spaced positions to move the guide rail 13 in an x-displacement direction 53 orthogonally to the shaft wall 15. FIG. 3C uses force arrows 55 to illustrate the opposite x-directions and -x-directions in which opposing forces $F_x$ or $F_{-x}$ can be exerted by one of the second and one of the third impact transmission devices 39, 41 at laterally spaced positions on the base region 45 of the guide rail 13 in order to bring about a torque on the guide rail 13 and thus to reorient the guide rail 13 in a rotational movement direction 57.

Figure 4:
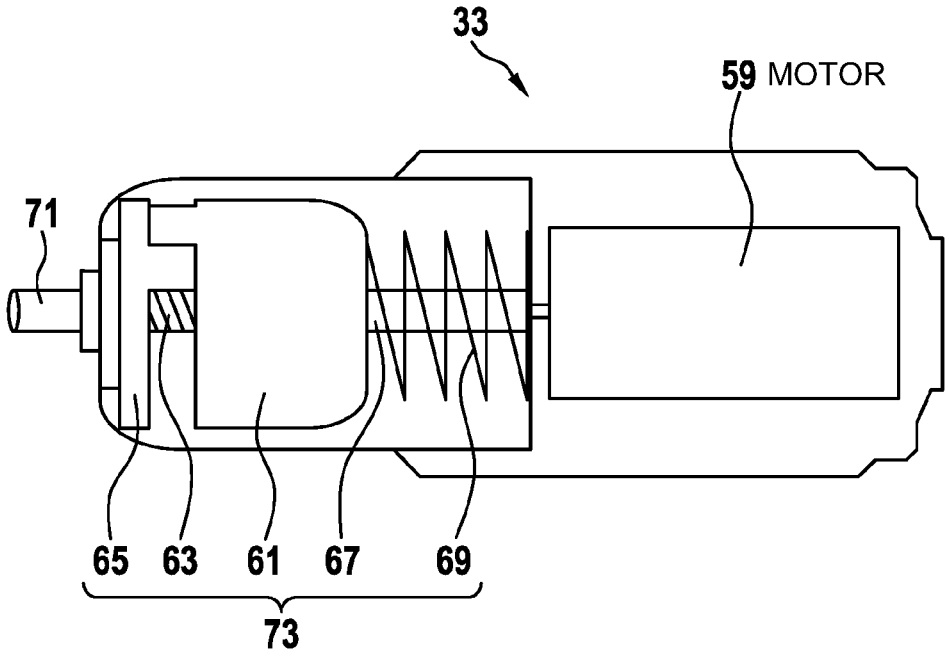
FIG. 4 shows an embodiment of an actuator for a hammer mill of an aligning device according to the invention.

FIG. 4 shows an example of an actuator 33 of the kind that can be used to generate pulse-like strikes in a hammer mill 25 of an aligning device 3. The actuator 33 is constructed similarly to actuators that are used in impact drills.

The actuator 33 has a motor 59 in the form of an electric motor. The motor 59 drives a shaft 67 in a rotating manner. The shaft 67 in turn drives a spindle 63 in a rotating manner. A weight element 61 is supported on the spindle 63. The weight element 61 is elastically pretensioned by a spring 69 towards a stop element 65. When the spindle 63 rotates, it displaces the weight element 61 successively against the force of the spring 69. At a predetermined rotational position, the weight element 61 is briefly released from the rotating spindle 63 and is then accelerated by the pretensioned spring 69 towards the stop element 65. The weight element 61 then strikes the stop element 65 and in this way, with the force impulse generated in this way, generates the desired pulse-like strike on a bolt 71 coupled to the stop element 65. The weight element 61, the spindle 63, the stop element 65, the shaft 67, and the spring 69 together form a hammer mechanism 73.

Finally, it should be noted that terms such as "comprising," "having," etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An aligning device for aligning a guide rail of an elevator system, wherein the guide rail is held on a shaft wall of an elevator shaft and is displaceable in at least two horizontal directions oriented crosswise with respect to one another before a final fixation of the guide rail, the aligning device comprising:

a detection device adapted to automatically detect a position deviation of the guide rail from a predetermined nominal position in the elevator shaft; and a hammer mill adapted to automatically hammer the guide rail in response to the detected position deviation toward the nominal position by exerting pulse-like strikes in at least one of the at least two horizontal directions.

2. The aligning device according to claim 1 wherein the hammer mill is adapted to exert the pulse-like strikes on the guide rail in each of the at least two horizontal directions.

3. The aligning device according to claim 1 wherein the hammer mill is adapted to exert the pulse-like strikes on the guide rail in a one of the at least two horizontal directions that is orthogonal to the shaft wall at two positions that are spaced from each other in a horizontal direction parallel to the shaft wall.

4. The aligning device according to claim 1 wherein the hammer mill includes at least one actuator generating the pulse-like strikes and at least four impact transmission devices for transmitting the strikes generated by the at least one actuator to partial areas on the guide rail.

5. The aligning device according to claim 4 wherein the hammer mill includes at least six of the impact transmission devices for transmitting the strikes generated by the at least one actuator to the partial regions on the guide rail.

6. The aligning device according to claim 4 wherein the at least one actuator is arranged on a side of the guide rail facing away from the shaft wall and at least one of the at least four impact transmission devices reaches behind the guide rail on a side of the guide rail facing the shaft wall.

7. The aligning device according to claim 4 wherein the at least one actuator interacts with one of the at least four impact transmission devices and the hammer mill includes other actuators each interacting individually with an associated one of the at least four impact transmission devices.

8. The aligning device according to claim 4 wherein the at least one actuator has a rotatable motor and a hammer mechanism converting a rotational movement caused by the motor into a pulse-like linear movement to generate the pulse-like strikes.

9. The aligning device according to claim 1 wherein the detection device detects the position deviation by recognizing an actual position of the guide rail in the elevator relative to a position of a plumb bob serving as a reference for the nominal position.

10. The aligning device according to claim 1 wherein the detection device detects the position deviation by scanning the guide rail with a laser.

11. The aligning device according to claim 1 including a fixing device fixing the aligning device on an elevator component that is movable through the elevator shaft.

12. An elevator system comprising:

a guide rail held on a shaft wall of an elevator shaft of the elevator system;

a vertically movable elevator component guided in vertical movement by the guide rail; and an aligning device according to claim 1 wherein the aligning device is attached to the movable elevator component.

13. A method for aligning a guide rail of an elevator system, wherein the guide rail is held on a shaft wall of an elevator shaft and is displaceable in at least two horizontal directions oriented crosswise with respect to each other before a final fixation of the guide rail, the method comprising the steps of:

automatically detecting a position deviation of the guide rail from a predetermined nominal position in the elevator shaft by the detection device of the aligning device according to claim 1; and automatically displacing the guide rail by exerting the pulse-like strikes on the guide rail in at least one of the horizontal directions toward the nominal position using the hammer mill of the aligning device.

14. The method according to claim 13 including arranging at least two of the aligning device on the guide rail at the same time and exerting the pulse-like strikes on the guide rail either simultaneously by the at least two aligning devices or only by one of the at least two aligning device at a time.

* * * * *